US011460183B2

(12) United States Patent
Hou et al.

(10) Patent No.: US 11,460,183 B2
(45) Date of Patent: Oct. 4, 2022

(54) LIGHTING APPARATUS

(71) Applicant: XIAMEN LEEDARSON LIGHTING CO., LTD, Fujian (CN)

(72) Inventors: Shouqiang Hou, Fujian (CN); Yizhen Chen, Fujian (CN); Xiaoliang Wen, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/091,820

(22) Filed: Nov. 6, 2020

(65) Prior Publication Data

US 2021/0131656 A1 May 6, 2021

(30) Foreign Application Priority Data

Nov. 6, 2019 (CN) ..... 201921904561.9
Nov. 6, 2019 (CN) ..... 201921904812.3

(51) Int. Cl.

| | |
|---|---|
| ***F21V 23/04*** | (2006.01) |
| ***F21V 23/06*** | (2006.01) |
| ***F21V 23/00*** | (2015.01) |
| ***H05B 47/115*** | (2020.01) |
| ***F21V 21/30*** | (2006.01) |
| ***H05B 45/20*** | (2020.01) |
| *F21Y 115/10* | (2016.01) |

(52) U.S. Cl.

CPC ..... *F21V 23/0471* (2013.01); *F21V 21/30* (2013.01); *F21V 23/004* (2013.01); *F21V 23/06* (2013.01); *H05B 45/20* (2020.01); *H05B 47/115* (2020.01); *F21Y 2115/10* (2016.08)

(58) Field of Classification Search

CPC ..... F21V 23/0471; F21V 23/06; F21V 21/30; H05B 47/115; H05B 45/20

See application file for complete search history.

(56) References Cited

U.S. PATENT DOCUMENTS 10,505,326 B2 * 12/2019 Chien ..... H02G 3/14
2019/0214849 A1 * 7/2019 Hennessy ..... H02J 7/0044

* cited by examiner

*Primary Examiner* — Anne M Hines
(74) *Attorney, Agent, or Firm* — Chun-Ming Shih; Lanway IPR Services

(57) ABSTRACT

A lighting apparatus includes a container box, a light passing cover, a circuit board and a pair of electrical plugs. The container box has a top surface and a bottom surface. There is a light opening and an opaque area on the top surface. The light passing cover is attached to the light opening of the container box. The circuit board is mounted with multiple types of LED modules, a driver circuit and a motion sensor. The multiple types of LED modules are disposed under the light opening of the top surface of the container box. The driver circuit is disposed under the opaque area of the top surface of the container box. The pair of electrical plugs are fixed to the container box and electrically connected to the driver circuit for plugging to an electric socket.

19 Claims, 7 Drawing Sheets

LIGHTING APPARATUS

FIELD

The present invention is related to a lighting apparatus, and more particularly related to a lighting apparatus with a motion sensor.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

In the night time, people still need certain illumination. However, the light may also affect people to sleep well.

Sometimes, people will get up in darkness, and a smart lighting is very helpful on such situation.

It is beneficial to design a flexible and convenient solution for such purposes.

SUMMARY

In some embodiments, a lighting apparatus includes a container box, a light passing cover, a circuit board and a pair of electrical plugs.

The container box has a top surface and a bottom surface.

There is a light opening and an opaque area on the top surface.

The light passing cover is attached to the light opening of the container box.

The circuit board is mounted with multiple types of LED modules, a driver circuit and a motion sensor.

The multiple types of LED modules are disposed under the light opening of the top surface of the container box.

The driver circuit is disposed under the opaque area of the top surface of the container box.

The pair of electrical plugs are fixed to the container box and electrically connected to the driver circuit for plugging to an electric socket.

In some embodiments, the opaque area is a wireless charging area for placing an external device to be wirelessly charged.

In some embodiments, the container box is a rectangular box structure.

In some embodiments, there is a reflector surrounding the multiple types of LED modules to guide a light of the multiple types of LED modules to escape via the light opening.

In some embodiments, a manual switch is disposed on the container box. The manual switch is coupled to the driver circuit to indicate the driver circuit to change a setting when the manual switch is operated.

In some embodiments, the manual switch is used for changing a color and a color temperature by controlling the multiple types of LED modules.

In some embodiments, the manual switch has a switch base and a pin.

The switch facing to a switch opening on a lateral side of the container box.

The pin is inserted through the switch opening to couple with the switch base.

In some embodiments, the container box has a sleep switch to start a sleeping procedure of the driver circuit.

The driver circuit changes a mixed color temperature gradually during a sleep transition period.

In some embodiments, the driver circuit changes a mixed color gradually during the sleep transition period.

In some embodiments, the driver circuit determines a variation pattern and the sleep transition period by decoding a user biology parameter from a portable device carried by a user.

In some embodiments, the container box has a first rotation structure for changing a direction of the light opening.

In some embodiments, the lighting apparatus may also include a ground light source for emitting a ground light to illuminate a ground.

The ground light source is controlled separately by the driver circuit in response to the motion sensor.

In some embodiments, the container box has a second rotation structure for changing a sensing area of the motion sensor.

In some embodiments, the container box has an extending socket for detachably connecting an external device for routing electricity received from the pair of electrical plugs.

In some embodiments, an extended module has a processor is detachably plugged to the extending socket.

When the extended module is plugged, the processor instructs the driver circuit to control the multiple types of LED modules.

In some embodiments, the container box has a top cover with a reflector.

A top edge of the reflector forms the light opening.

A bottom edge of the reflector engages the circuit board.

In some embodiments, the pair of electrical plugs are fixed on the circuit board as an integrated module to be placed into the container box and then enclosed by the top cover.

In some embodiments, a light passing cover is attached to the top cover to cover the light opening.

In some embodiments, the multiple types of LED module is covered by a transparent electricity isolation layer.

In some embodiments, the top cover has multiple sub-cover with different colors to be selectively rotated to cover the light opening.

DETAILED DESCRIPTION

Figure 5:
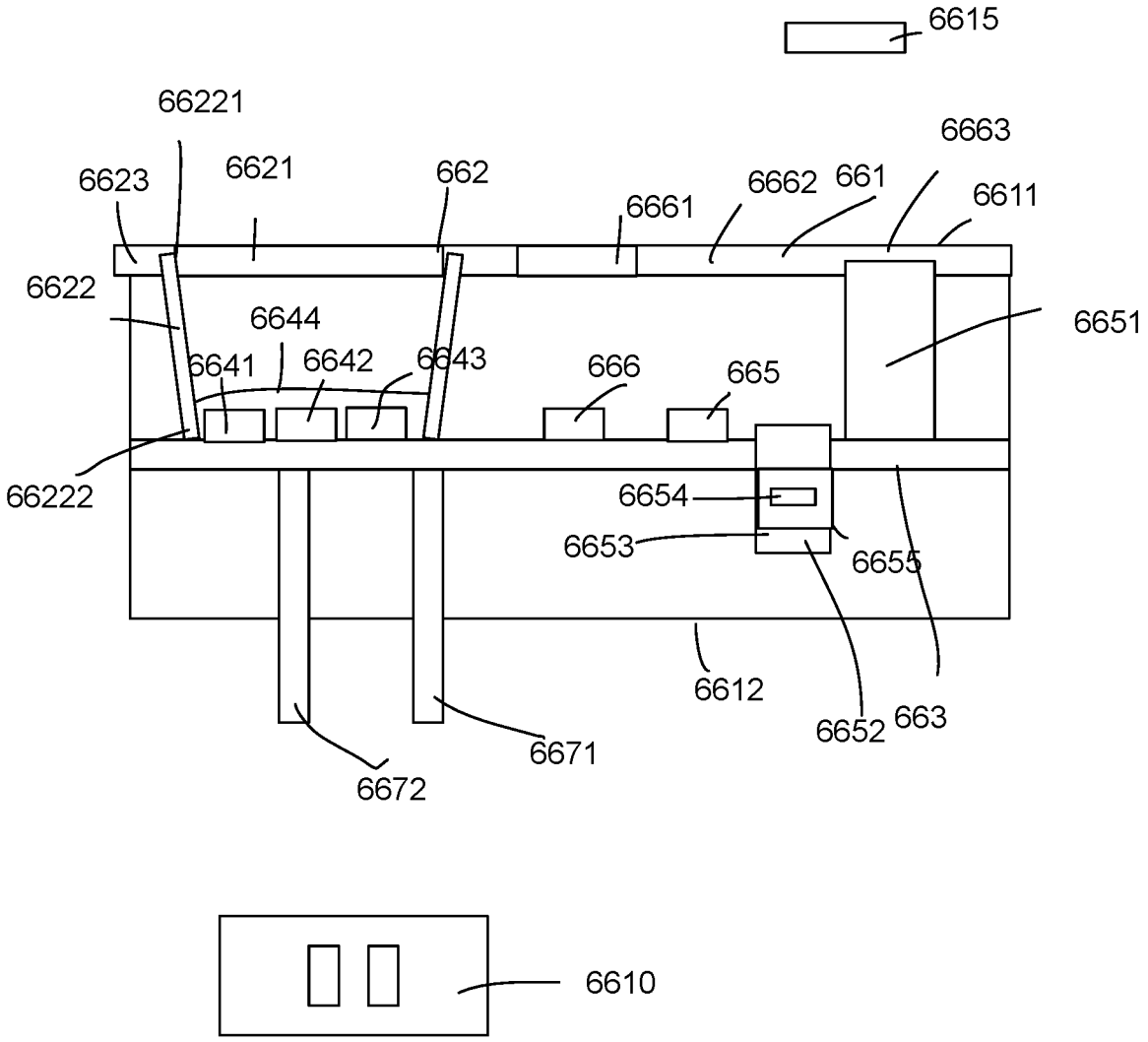
FIG. 5 shows another embodiment of a lighting apparatus.

In FIG. 5, a lighting apparatus includes a container box 661, a light passing cover 662, a circuit board 663 and a pair of electrical plugs 6671, 6672.

The container box 661 has a top surface 6611 and a bottom surface 6612.

There is a light opening 662 and an opaque area 6662 on the top surface 6611.

The light passing cover 6621 is attached to the light opening 662 of the container box 661.

The circuit board 663 is mounted with multiple types of LED modules 6641, 6642, 6643, a driver circuit 665 and a motion sensor 666.

The multiple types of LED modules 6641, 6642, 6643 are disposed under the light opening 662 of the top surface 6611 of the container box 661.

The driver circuit 665 is disposed under the opaque area 6622 of the top surface 6611 of the container box 661.

The pair of electrical plugs 6671, 6672 are fixed to the container box 661 and electrically connected to the driver circuit 665 for plugging to an electric socket 6610. The electric socket 6610 may be fixed on a wall connecting to a power source like an alternating current power 110V/220V power source.

In some embodiments, the opaque area 6662 has a wireless charging area 6663 for placing an external device 6615 to be wirelessly charged. For example, the external device 6615 is placed on the wireless charging area 6663 and a charging coil 6651 may be placed on the circuit board 663 for charging the external device 6615.

In some embodiments, the container box 661 is a rectangular box structure.

In some embodiments, there is a reflector 6622 surrounding the multiple types of LED modules 6641, 6642, 6643 to guide a light of the multiple types of LED modules 6641, 6642, 6643 to escape via the light opening 662.

In some embodiments, a manual switch 6652 is disposed on the container box 661. The manual switch 6652 is coupled to the driver circuit 665 to indicate the driver circuit 665 to change a setting when the manual switch 6652 is operated.

For example, the manual switch 6652 may have a sliding switch with multiple options corresponding to different color temperatures, timing, colors, or other settings.

In some embodiments, the manual switch is used for changing a color and a color temperature by controlling the multiple types of LED modules.

In some embodiments, the manual switch 6652 has a switch base 6653 and a pin 6654.

The switch base 6653 is facing to a switch opening 6655 on a lateral side of the container box 661.

The pin 6654 is inserted through the switch opening 6655 to couple with the switch base 6653.

In some embodiments, the container box 661 has a sleep switch, e.g. using the manual switch 6652, to start a sleeping procedure of the driver circuit 665. The sleep switch may also be implemented as a touch operation on the opaque area or the light passing area.

The driver circuit 665 changes a mixed color temperature gradually during a sleep transition period. For example, 10 minutes are set as the sleep transition period. During the sleep transition period, the light is changing to a warmer color temperature to help people to get into sleeping, and the light intensity is decreasing gradually. After 10 minutes, the driver circuit 665 controls the LED modules to emit a predetermined light or just turns off all the lights.

In some embodiments, the driver circuit changes a mixed color gradually during the sleep transition period.

In some embodiments, the driver circuit determines a variation pattern and the sleep transition period by decoding a user biology parameter from a portable device carried by a user. For example, users may carry an Apple watch that collects sleeping information of the users. An app may be developed using the Apple watch or other portable device to collect biological information of the users related to the sleeping. The information is passed to the driver circuit to provide an optimized control of the LED modules.

Figure 6:
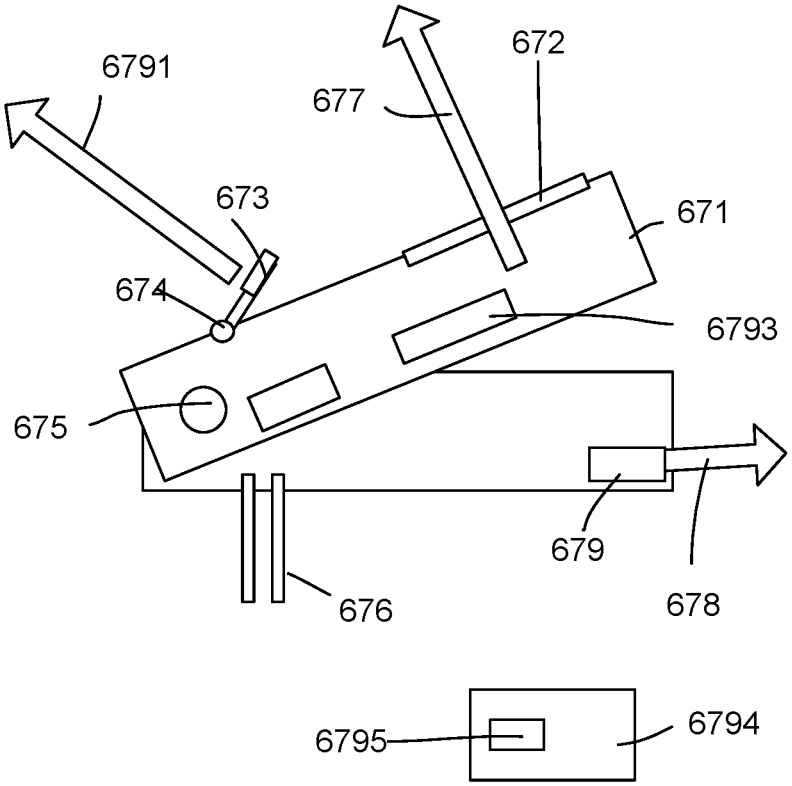
FIG. 6 shows another embodiment with rotation structures.

In FIG. 6, the container box 671 has a first rotation structure 675 for changing a direction 677 of the light opening 672.

In some embodiments, the lighting apparatus may also include a ground light source 679 for emitting a ground light 678 to illuminate a ground.

The ground light source 679 is controlled separately by the driver circuit in response to the motion sensor.

In some embodiments, the container box 671 has a second rotation structure 674 for changing a sensing area 6791 of the motion sensor 673.

In some embodiments, the container box has an extending socket 6793 for detachably connecting an external device 6794 for routing electricity received from the pair of electrical plugs 676.

In some embodiments, an extended module 6794 has a processor is detachably plugged to the extending socket 6793.

When the extended module 6794 is plugged, the processor 6795 instructs the driver circuit to control the multiple types of LED modules.

In FIG. 5, the container box has a top cover 6623 with a reflector 6622.

A top edge 66221 of the reflector 6622 forms the light opening 662.

A bottom edge 66222 of the reflector 6622 engages the circuit board 663.

In some embodiments, the pair of electrical plugs 6671, 6672 are fixed on the circuit board 663 as an integrated module to be placed into the container box and then enclosed by the top cover.

In some embodiments, a light passing cover 6621 is attached to the top cover 6623 to cover the light opening 662.

In some embodiments, the multiple types of LED module 6641, 6642, 6643 are covered by a transparent electricity isolation layer 6644.

Figure 7:
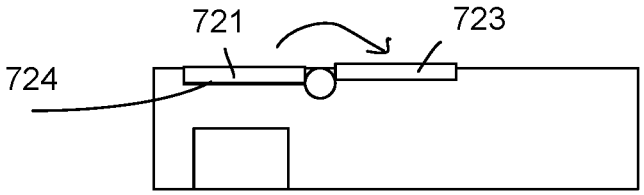
FIG. 7 shows another embodiment that has multiple sub-covers.

In FIG. 7, the top cover has multiple sub-covers 721, 723 with different colors to be selectively rotated to cover the light opening 724.

Figure 1:
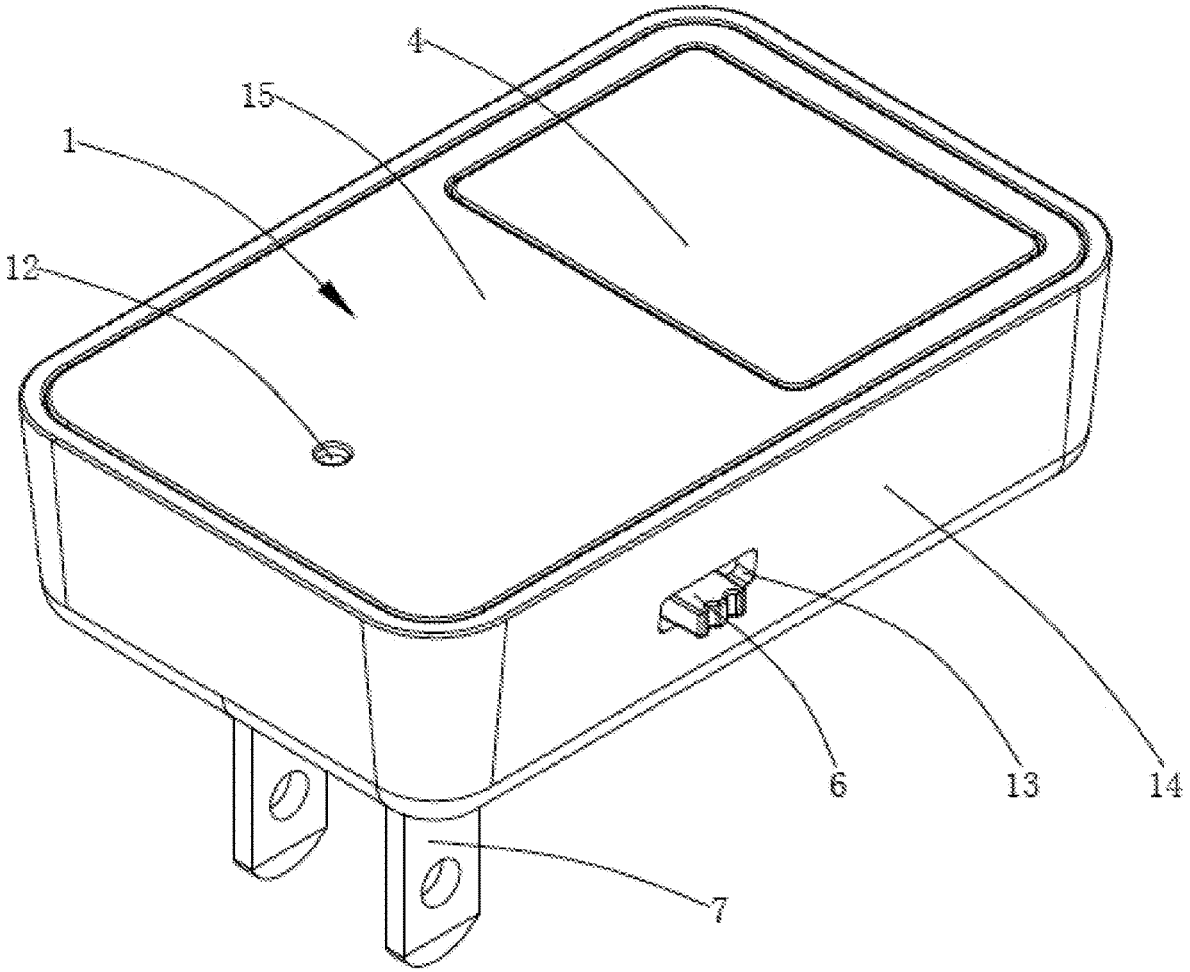
FIG. 1 illustrates a lighting apparatus embodiment.

Please refer to FIG. 1, which illustrates a lighting apparatus. The lighting apparatus has a container box 1 that includes a bottom cover 14 and a top cover 15. There is a passage hole 12 for a motion sensor to collection motion information. The manual switch 6 has a pin passing through a switch hole 13. The electrical plugs 7 are disposed on the container box 1.

Figure 2:
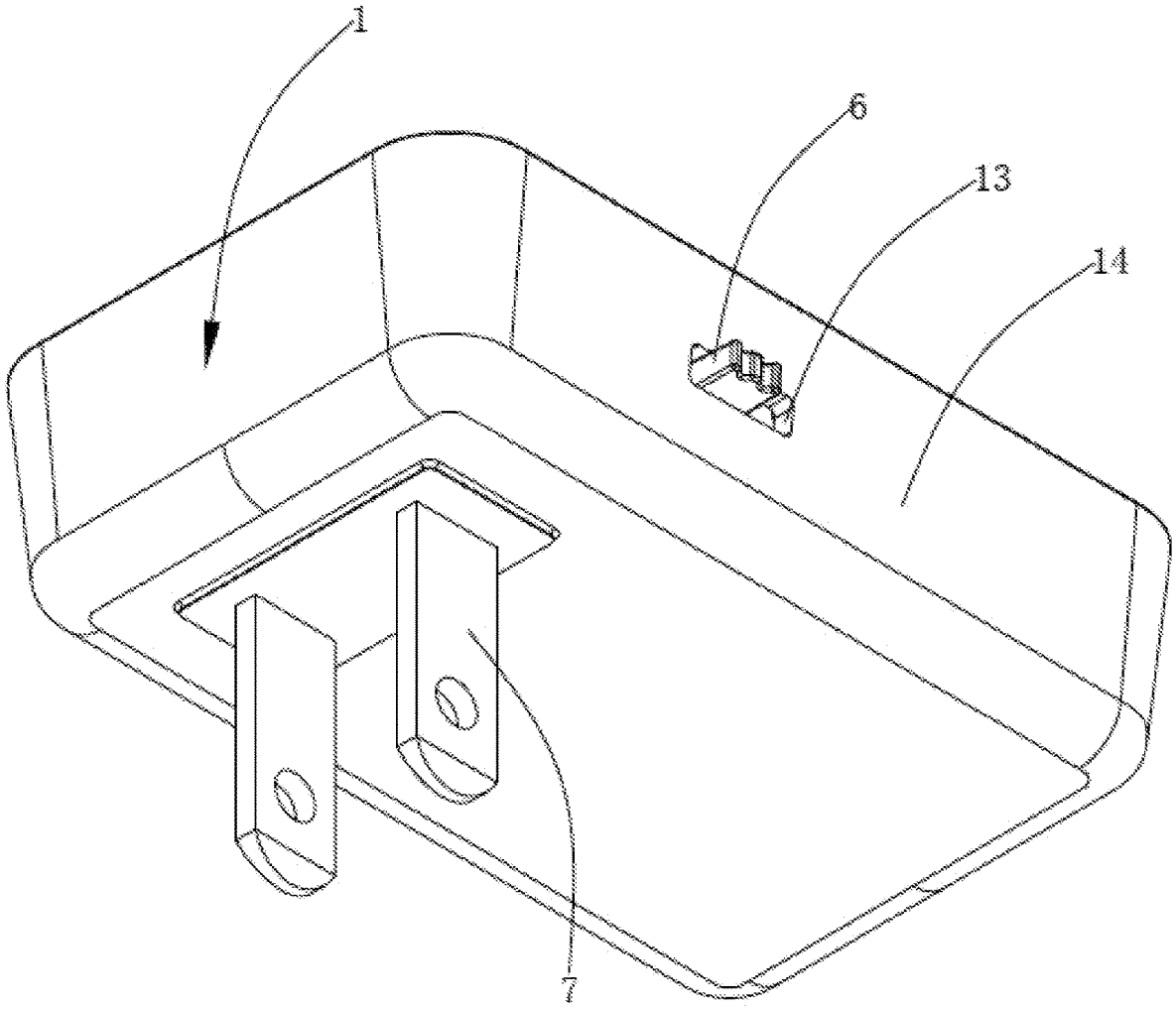
FIG. 2 illustrates another view of the example in FIG. 1.

FIG. 2 shows another view of the example in FIG. 1.

The same reference numerals refer to the same components. If they are explained once, these components may not be repeated again for appearing in another drawing.

Figure 3:
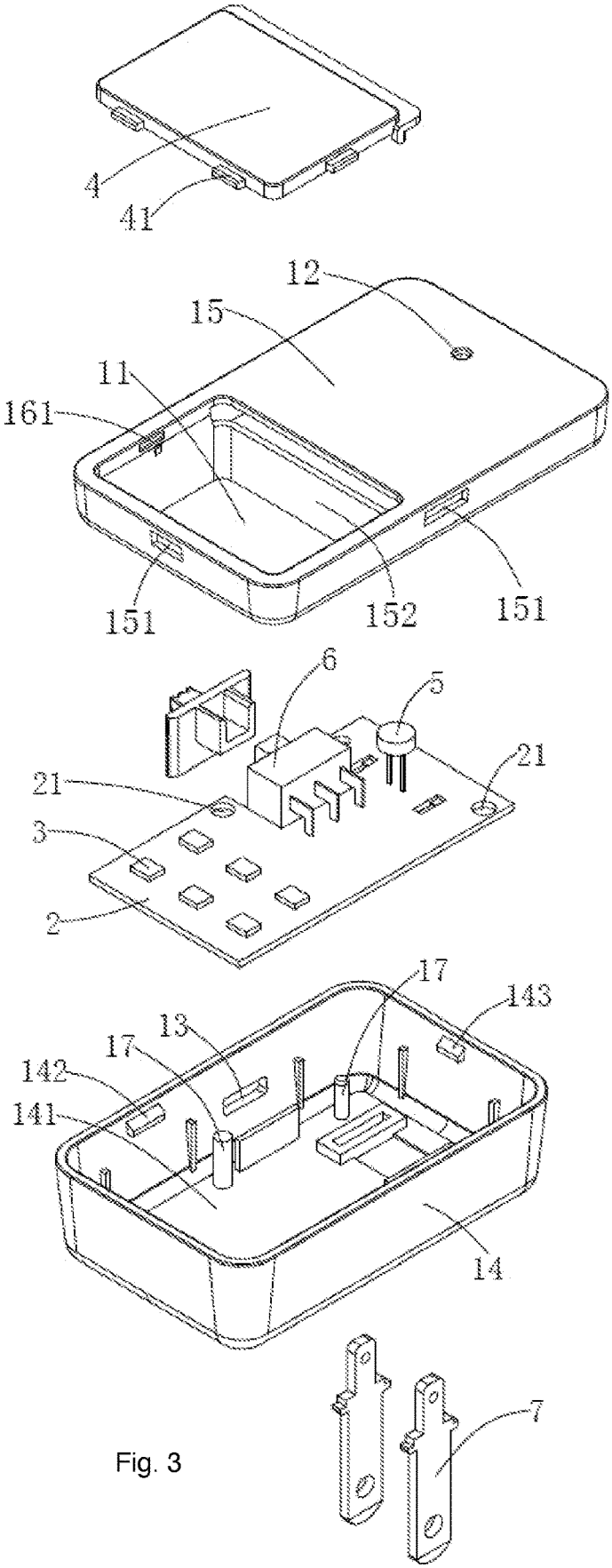
FIG. 3 illustrates an exploded view of the example in FIG. 1.

FIG. 3 shows an exploded view of the example in FIG. 1.

In FIG. 3, the top cover 15 has a light opening 11. There are limiting grooves 161, 151 corresponding to protruding units 41 of the light passing cover 4 to fix the light passing cover 4 to the top cover 15. There is a circular tube used as a reflector 152.

A dip switch base 6 is placed on a circuit board 2. There are LED modules 3 on the circuit board 2. There is a light sensor 5 used as the motion sensor mentioned above. There are aligning holes 21 corresponding to aligning columns 17 of the bottom cover 14.

The buckle 143 is used for clipping to the top cover 15. The circuit board 2 is placed in the container 141. There is protruding block 142 for matching to grooves of the top cover 15.

Figure 4:
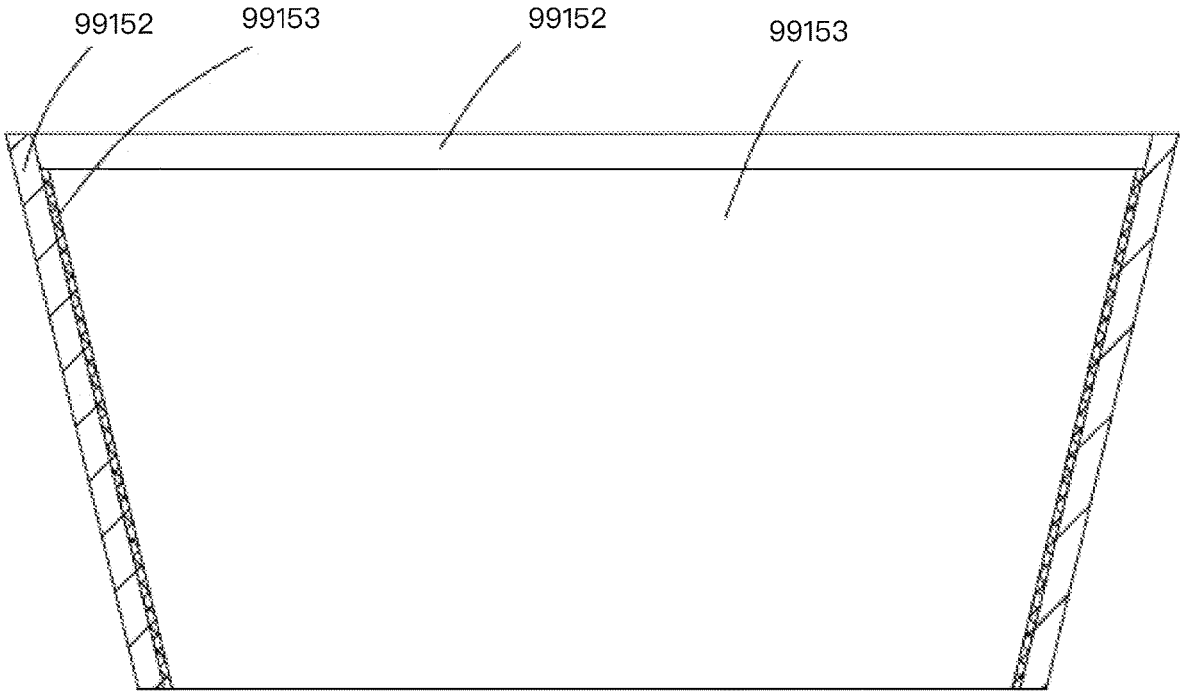
FIG. 4 illustrates a reflector example.

FIG. 4 shows a reflecting layer 99153 with four sides placed on a tubular structure 99152 for reflecting lights to the light passing cover 99152.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a container box with a top surface and a bottom surface, wherein there is a light opening and an opaque area on the top surface;

a light passing cover attached to the light opening of the container box;

a circuit board mounted with multiple types of LED modules, a driver circuit and a motion sensor, wherein the multiple types of LED modules are disposed under the light opening of the top surface of the container box, the driver circuit is disposed under the opaque area of the top surface of the container box; and a pair of electrical plugs fixed to the container box and electrically connected to the driver circuit for plugging to an electric socket, wherein there is a reflector surrounding the multiple types of LED modules to guide a light of the multiple types of LED modules to escape via the light opening and to separate the multiple types of LED modules from the driver circuit.

2. The lighting apparatus of claim 1, wherein the opaque area is a wireless charging area for placing an external device to be wirelessly charged.

3. The lighting apparatus of claim 1, wherein the container box is a rectangular box structure.

4. The lighting apparatus of claim 1, wherein a manual switch is disposed on the container box, the manual switch is coupled to the driver circuit to indicate the driver circuit to change a setting when the manual switch is operated.

5. The lighting apparatus of claim 4, wherein the manual switch is used for changing a color and a color temperature by controlling the multiple types of LED modules.

6. The lighting apparatus of claim 4, wherein the manual switch has a switch base and a pin, the switch base is facing to a switch opening on a lateral side of the container box, the pin is inserted through the switch opening to couple with the switch base.

7. The lighting apparatus of claim 1, wherein the container box has a sleep switch to start a sleeping procedure of the driver circuit, the driver circuit changes a mixed color temperature gradually during a sleep transition period.

8. The lighting apparatus of claim 7, wherein the driver circuit changes a mixed color gradually during the sleep transition period.

9. The lighting apparatus of claim 7, wherein the driver circuit determines a variation pattern and the sleep transition period by decoding a user biology parameter from a portable device carried by a user.

10. The lighting apparatus of claim 1, wherein the container box has a first rotation structure for changing a direction of the light opening.

11. The lighting apparatus of claim 10, further comprising a ground light source for emitting a ground light to illuminate a ground, the ground light source is controlled separately by the driver circuit in response to the motion sensor.

12. The lighting apparatus of claim 10, wherein the container box has a second rotation structure for changing a sensing area of the motion sensor.

13. The lighting apparatus of claim 1, wherein the container box has an extending socket for detachably connecting an external device for routing electricity received from the pair of electrical plugs.

14. The lighting apparatus of claim 13, wherein an extended module has a processor detachably plugged to the extending socket, when the processor is plugged, the processor instructs the driver circuit how to control the multiple types of LED modules.

15. The lighting apparatus of claim 1, wherein the container box has a top cover with a reflector, a top edge of the reflector forms the light opening, a bottom edge of the reflector engages the circuit board.

16. The lighting apparatus of claim 15, wherein the pair of electrical plugs are fixed on the circuit board as an integrated module to be placed into the container box and then enclosed by the top cover.

17. The lighting apparatus of claim 15, wherein the motion sensor collects a gesture of a user and the driver circuit.

18. The lighting apparatus of claim 15, wherein the multiple types of LED module is covered by a transparent electricity isolation layer.

19. The lighting apparatus of claim 15, wherein the top cover has multiple sub-cover with different colors to be selectively rotated to cover the light opening.

* * * * *